US010457038B2

(12) United States Patent
Matsunaga et al.

(10) Patent No.: US 10,457,038 B2
(45) Date of Patent: Oct. 29, 2019

(54) INK JET PRINTER PROVIDED WITH MOVABLE SHUTTLE

(71) Applicant: RISO KAGAKU CORPORATION, Tokyo (JP)

(72) Inventors: Katsuhiko Matsunaga, Ibaraki (JP); Atsushi Tanaka, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/062,873

(22) PCT Filed: Dec. 5, 2016

(86) PCT No.: PCT/JP2016/086037
§ 371 (c)(1),
(2) Date: Jun. 15, 2018

(87) PCT Pub. No.: WO2017/104462
PCT Pub. Date: Jun. 22, 2017

(65) Prior Publication Data

US 2018/0370226 A1 Dec. 27, 2018

(30) Foreign Application Priority Data

Dec. 16, 2015 (JP) ..... 2015-244833

(51) Int. Cl.
*B41J 2/01* (2006.01)
*B41J 19/02* (2006.01)
(Continued)

(52) U.S. Cl.
CPC ..... *B41J 2/01* (2013.01); *B41J 19/02* (2013.01); *B41J 19/18* (2013.01); *B41J 19/20* (2013.01)

(58) Field of Classification Search
CPC ..... B41J 9/02; B41J 19/18; B41J 19/20
See application file for complete search history.

(56) References Cited

U.S. PATENT DOCUMENTS

2008/0238995 A1 10/2008 Menendez et al.
2010/0220141 A1 9/2010 Ozawa

FOREIGN PATENT DOCUMENTS

EP 1721748 A1 11/2006
JP 08-112956 5/1996
(Continued)

OTHER PUBLICATIONS

Official Communication issued in International Patent Application No. PCT/JP2016/086037, dated Feb. 14, 2017, along with English-language translation.
(Continued)

*Primary Examiner* — Julian D Huffman
(74) *Attorney, Agent, or Firm* — Greenblum & Bernstein, P.L.C.

(57) ABSTRACT

A controller forms an image on a print medium by alternately repeating: a first operation of driving an inkjet head to eject ink from the inkjet head to the print medium while driving a main scanning driver to move the inkjet head in a main scanning direction; and a second operation of driving a sub-scanning driver to move a shuttle in the sub-scanning direction. The controller performs a multi-stage brake control to stop the shuttle in the second operation, and in a second stage and a stage after the second stage of the multi-stage brake control, apply brake to the shuttle at such a timing that a direction of vibration of the shuttle and a direction of force of inertia of the shuttle in braking of the shuttle are opposite to each other.

2 Claims, 6 Drawing Sheets

(51) Int. Cl.
*B41J 19/18* (2006.01)
*B41J 19/20* (2006.01)

(56) References Cited

FOREIGN PATENT DOCUMENTS

| | | | |
|---|---|---|---|
| JP | 2008-279727 | | 11/2008 |
| JP | 2010-042382 | | 2/2010 |
| JP | 2015-58553 | A | 3/2015 |
| WO | 2007/125902 | A1 | 11/2007 |

OTHER PUBLICATIONS

Jul. 8, 2019 Extended European Search Report in corresponding European Application No. 16875445.5.

INK JET PRINTER PROVIDED WITH MOVABLE SHUTTLE

TECHNICAL FIELD

The present invention relates to an inkjet printer which performs printing by ejecting ink from an inkjet head.

BACKGROUND ART

Patent Literature 1 describes an inkjet printer including a shuttle in which an inkjet head movable in a main scanning direction is mounted and a mechanism which moves the shuttle in the sub-scanning direction.

The aforementioned inkjet printer performs a print operation of one pass in which printing is performed by ejecting the ink from the inkjet head to the print medium while moving the inkjet head in the main scanning direction, and then moves the shuttle in the sub-scanning direction. The inkjet printer repeats these operations to form an image on the print medium.

In the printing performed as described above, vibration occurs in the shuttle when the shuttle is moved in the sub-scanning direction. When the next print operation of one pass is performed with the shuttle still vibrating after the moving thereof, the direction in which the ink is ejected is disturbed due to the effect of the vibration and print quality may decrease.

To counter this, it is conceivable to provide a waiting time for the vibration to stop on its own after the moving of the shuttle. This can suppress a decrease in print quality due to the vibration of the shuttle.

CITATION LIST

Patent Literature

Patent Literature 1: Japanese Patent Application Publication No. 2008-279727

SUMMARY OF INVENTION

Waiting for the vibration to stop by providing the waiting time after the completion of the moving of the shuttle increases the time from the completion of one print operation to the start of the next print operation of one pass. Accordingly, the time from start to completion of printing increases and the productivity of a printed matter decreases.

An object of the present invention is to provide an inkjet printer which can suppress a decrease in print quality while suppressing a decrease in productivity of a printed matter.

An inkjet printer in accordance with some embodiments of the present invention includes: a shuttle including an inkjet head and a main scanning driver configured to move the inkjet head in a main scanning direction; a sub-scanning driver configured to move the shuttle in a sub-scanning direction; and a controller configured to control the inkjet head, the main scanning driver, and the sub-scanning driver. The controller is configured to alternately repeat a first operation and a second operation to form an image on a print medium, the first operation being an operation of driving the inkjet head to eject ink from the inkjet head to the print medium while driving the main scanning driver to move the inkjet head in the main scanning direction, the second operation being an operation of driving the sub-scanning driver to move the shuttle in the sub-scanning direction. The controller is configured to perform a multi-stage brake control to stop the shuttle in the second operation, and in a second stage and a stage after the second stage of the multi-stage brake control, apply brake to the shuttle at such a timing that a direction of vibration of the shuttle and a direction of force of inertia of the shuttle in braking of the shuttle are opposite to each other.

The configuration described above can reduce the time required for the convergence of the vibration of the shuttle. As a result, it is possible to reduce the time from the completion of one print operation to the start of the next print operation of one pass, and thus reduce the time from the start to completion of printing on the print medium. Hence, the inkjet printer can suppress a decrease in print quality due to the vibration of the shuttle while suppressing a decrease in productivity of a printed matter.

The controller may perform the multi-stage brake control of a number of stages depending on a movement distance of the shuttle in one pitch.

In the aforementioned configuration, the control depending on tendency of vibration in each movement distance of the shuttle is performed and the time required for the convergence of the vibration of the shuttle can be thus reduced.

DESCRIPTION OF EMBODIMENTS

Figure 1:
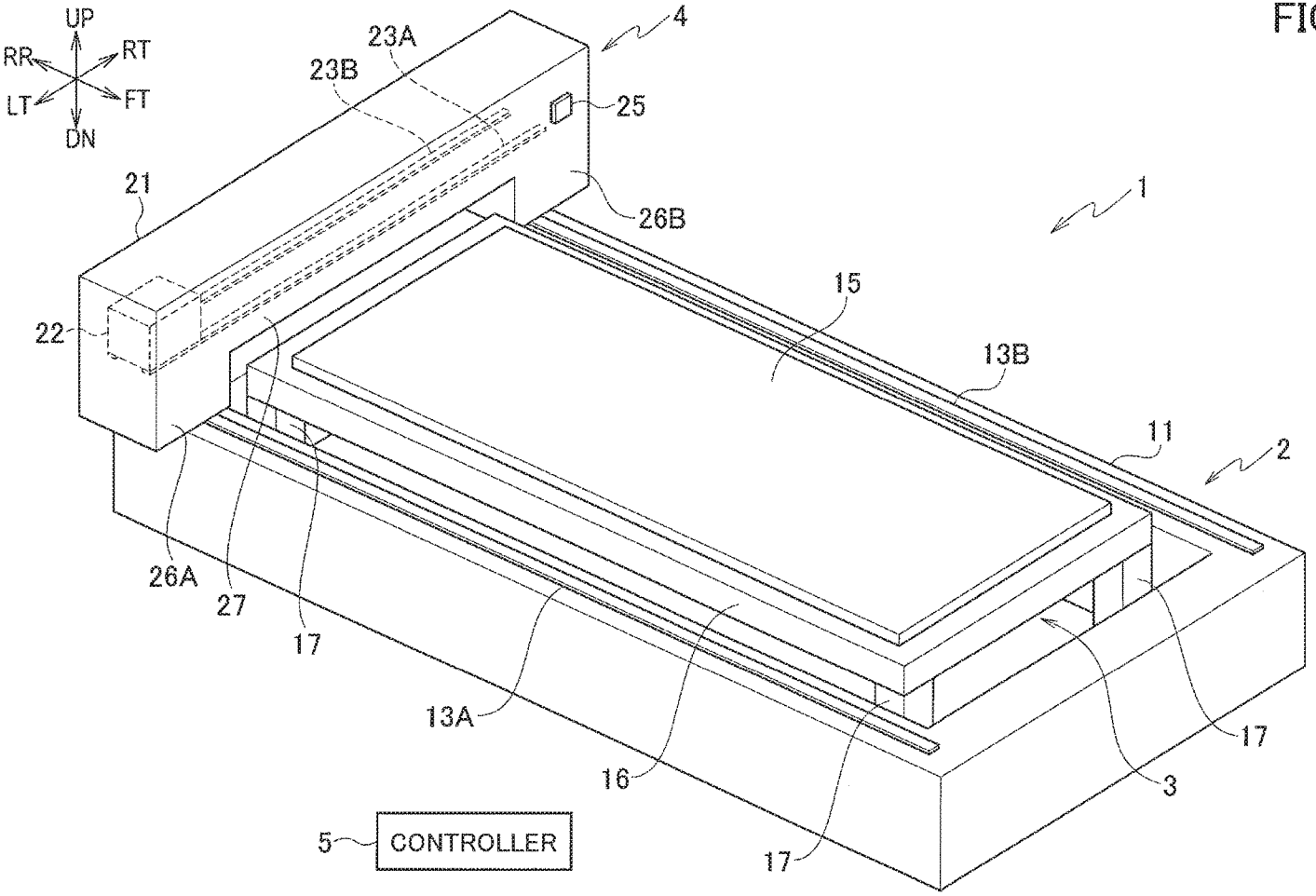
FIG. 1 is a perspective view illustrating a schematic configuration of an inkjet printer according to a first embodiment.

Embodiments of the present invention are described below with reference to the drawings. The same or similar parts and components in the drawings are denoted by the same or similar reference numerals.

The embodiments described below are examples of device and the like for embodying the technical idea of the present invention. The technical idea of the present invention does not specify the materials, shapes, structures, arrangements, and the like of the components to those described below. Various changes can be added to the technical idea of the present invention within the scope of claims.

(First Embodiment)

Figure 2:
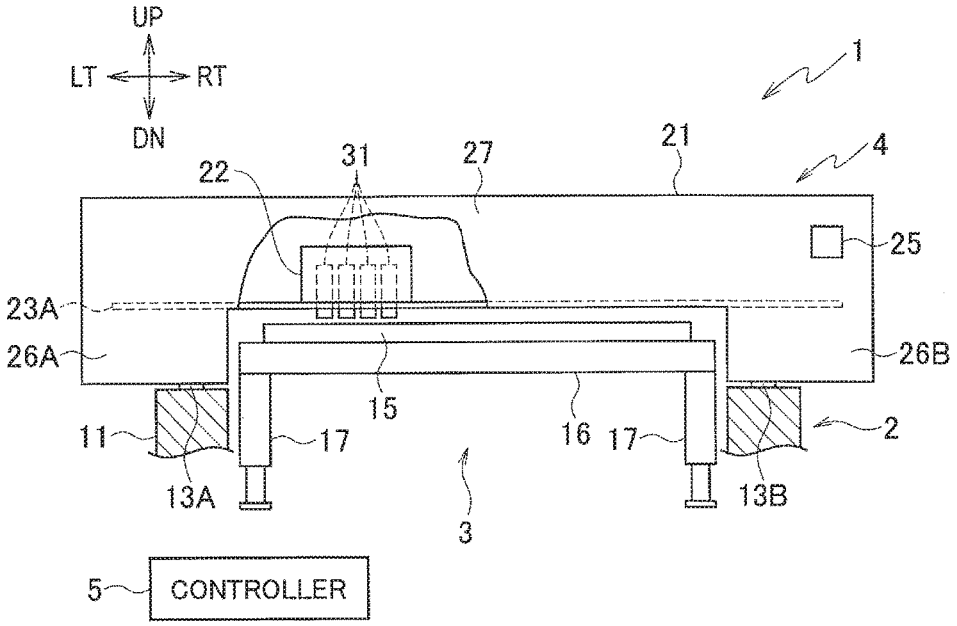
FIG. 2 is a front view of a main portion of the inkjet printer illustrated in FIG. 1.
Figure 3:
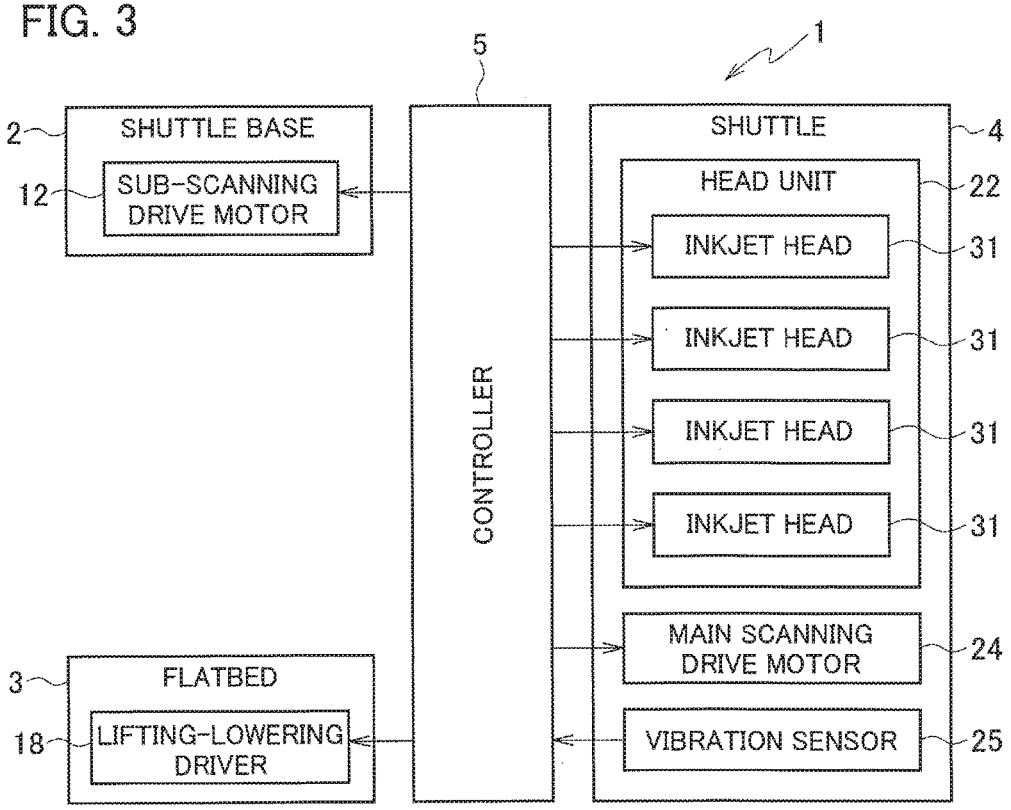
FIG. 3 is a control block diagram of the inkjet printer illustrated in FIG. 1.
Figure 6:
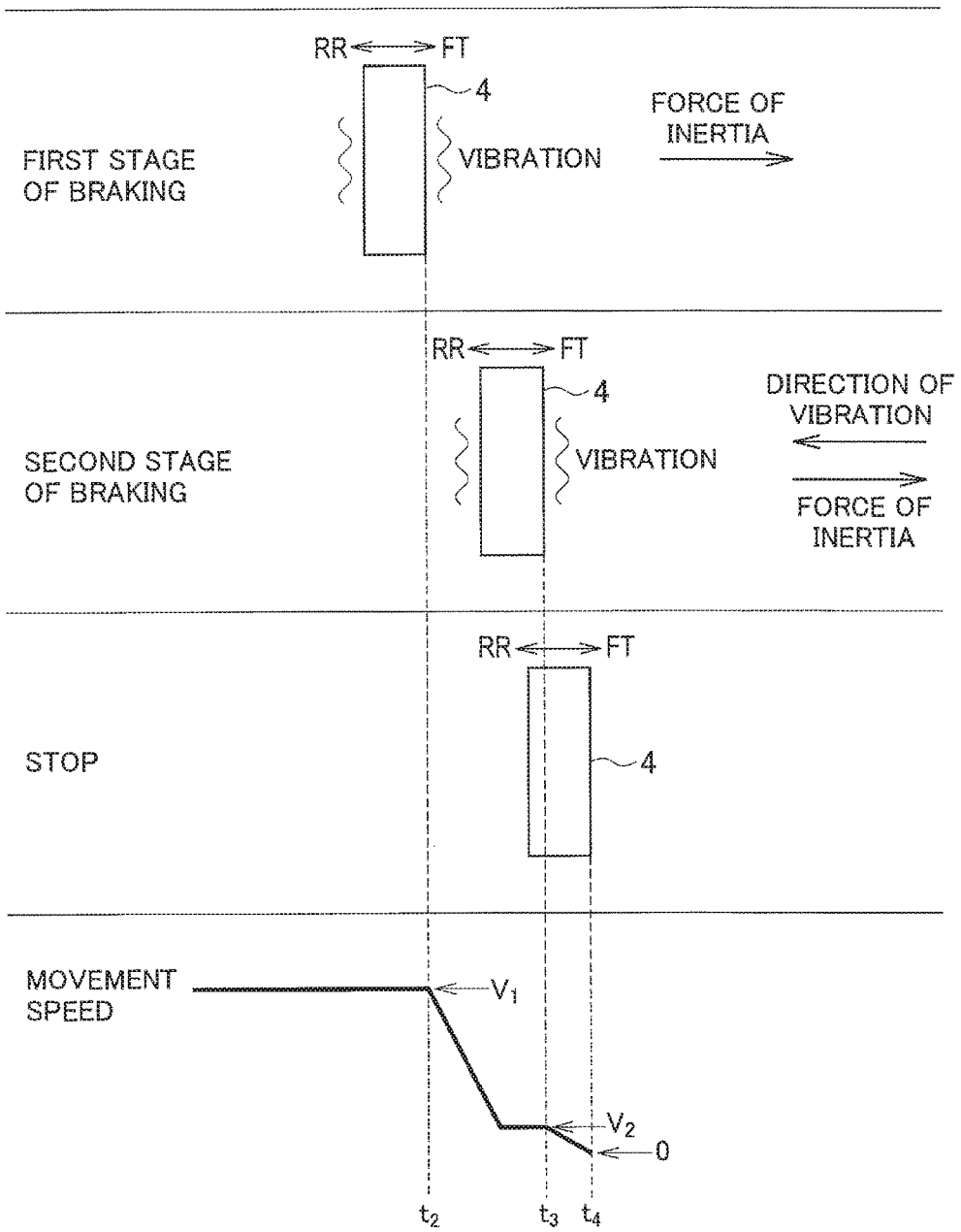
FIG. 6 is a diagram explaining a principle of canceling out the vibration of the shuttle.

FIG. 1 is a perspective view illustrating a schematic configuration of an inkjet printer in a first embodiment of the present invention. FIG. 2 is a front view of a main portion of the inkjet printer illustrated in FIG. 1. FIG. 3 is a control block diagram of the inkjet printer illustrated in FIG. 1. In FIGS. 1, 2, and 6, rightward, leftward, upward, downward, forward, and rearward directions are denoted by RT, LT, UP, DN, FT, and RR, respectively.

As illustrated in FIGS. 1 to 3, the inkjet printer 1 according to the first embodiment includes a shuttle base 2, a flatbed 3, a shuttle 4, and a controller 5.

The shuttle base 2 supports the shuttle 4 and moves the shuttle 4 in a front-rear direction (sub-scanning direction). The shuttle base 2 includes a pedestal 11 and a sub-scanning drive motor (sub-scanning driver) 12.

The pedestal 11 supports the shuttle 4. The pedestal 11 is formed in a rectangular frame shape. Sub-scanning drive guides 13A, 13B extending in the front-rear direction are formed respectively on left and right frames of the pedestal 11. The sub-scanning drive guides 13A, 13B guide the shuttle 4 moving in the front-rear direction.

The sub-scanning drive motor 12 moves the shuttle 4 in the front-rear direction.

The flatbed 3 supports a print medium 15 such as a building material. The flatbed 3 is arranged inside the pedestal 11 of the shuttle base 2. The flatbed 3 includes a placing table 16, multiple legs 17, and a lifting-lowering driver 18.

The placing table 16 is a table on which the print medium 15 is placed. An upper surface of the placing table 16 on which the print medium 15 is placed is a horizontal surface.

The legs 17 support the placing table 16. The legs 17 are configured to be telescopic. The placing table 16 can be thereby lifted and lowered.

The lifting-lowering driver 18 lifts and lowers the placing table 16. The lifting-lowering driver 18 is formed of a hydraulic lifting-lowering mechanism and the like.

The shuttle 4 prints an image on the print medium 15. The shuttle 4 includes a case 21, a head unit 22, a main scanning drive guides 23A, 23B, a main scanning drive motor (main scanning driver) 24, and a vibration sensor 25.

The case 21 houses the head unit 22 and the main scanning drive guides 23A, 23B. The case 21 is formed in a shape of a gate bridging over the flatbed 3 in a left-right direction. Left and right legs 26A, 26B of the case 21 are supported on the pedestal 11 of the shuttle base 2 to be movable along the sub-scanning drive guides 13A, 13B. A horizontal portion 27 between the legs 26A, 26B of the case 21 is open on a lower side so that inks can be ejected from the head unit 22 to the print medium 15.

The head unit 22 has four inkjet heads 31. The four inkjet heads 31 are arranged parallel to one another in the left-right direction. Each inkjet head 31 has multiple nozzles (not illustrated) which are open on a nozzle surface being a lower surface of the inkjet head 31 and which are arranged in the front-rear direction, and ejects the ink from the nozzles to the print medium 15. The four inkjet heads 31 eject inks of different colors (for example, cyan, black, magenta, and yellow), respectively. The head unit 22 is arranged in the case 21 and is movable in the left-right direction (main scanning direction).

The main scanning drive guides 23A, 23B guide the head unit 22 moving in the left-right direction. The main scanning drive guides 23A, 23B are laid horizontally between the legs 26A, 26B in the case 21.

The main scanning drive motor 24 moves the head unit 22 in the left-right direction.

The vibration sensor 25 detects the vibration of the shuttle 4.

The controller 5 controls operations of the units in the inkjet printer 1. The controller 5 includes a CPU, a RAM, a ROM, a hard disk drive, and the like.

The controller 5 performs printing of one pass by causing the inks to be ejected from the inkjet heads 31 to the print medium 15 while driving the units to move the head unit 22 in the main scanning direction, and then moves the shuttle 4 forward. The controller 5 alternately repeats the print operation of one pass and the moving of the shuttle 4 to form an image on the print medium 15. In such printing, vibration occurs in the shuttle 4 when the shuttle 4 is moved.

In the moving of the shuttle 4, the controller 5 performs multi-stage brake control upon stopping the shuttle 4. In this case, in the second stage and beyond of the brake control, the controller 5 applies brake at such a timing that the direction of force of inertia in the braking of the shuttle 4 is opposite to the direction of the vibration of the shuttle 4.

Next, operations of the inkjet printer 1 are described.

When the inkjet printer 1 is to perform printing, the print medium 15 is placed on the placing table 16 before the start of the print operation. Then, when the inkjet printer 1 receives a print job from an external personal computer, the controller 5 adjusts the height of the placing table 16. Specifically, the controller 5 drives the lifting-lowering driver 18 and adjusts the height of the placing table 16 to adjust a head gap which is the distance between the inkjet heads 31 and the print medium 15, depending on the type (thickness) of the print medium 15. In this case, the controller 5 determines the type of the print medium 15 based on setting information included in the print job.

Next, the controller 5 drives the sub-scanning drive motor 12 to move the shuttle 4 to a print start position near a rear end of the print medium 15.

Then, the controller 5 performs the printing of one pass by driving the inkjet heads 31 to eject the inks from the inkjet heads 31 to the print medium 15 while driving the main scanning drive motor 24 to move the head unit 22 in the main scanning direction.

Next, the controller 5 drives the sub-scanning drive motor 12 to move the shuttle 4 forward by one pitch.

Then, the controller 5 performs control such that the print operation of one pass and the moving of the shuttle 4 by one pitch are alternately repeated. When the last print operation of one pass is completed, the image formation on the print medium 15 is completed and the series of operations is completed.

Next, operations in the moving of the shuttle 4 are described.

Figure 4:
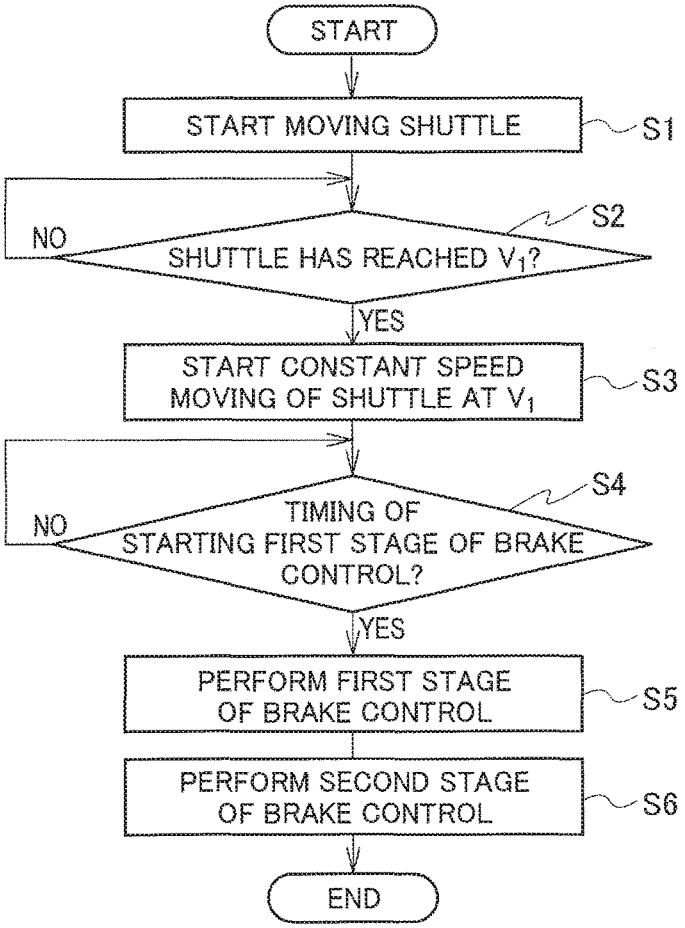
FIG. 4 is a flowchart for explaining operations performed in moving of a shuttle when brake control is two-stage brake control in the first embodiment.

Here, description is given of the case where the brake control for stopping the shuttle 4 is two-stage brake control. FIG. 4 is a flowchart for explaining operations performed in the moving of the shuttle 4 when the brake control is two-stage brake control. The processing of the flowchart of FIG. 4 is started when the print operation of one pass is completed.

Figure 5:
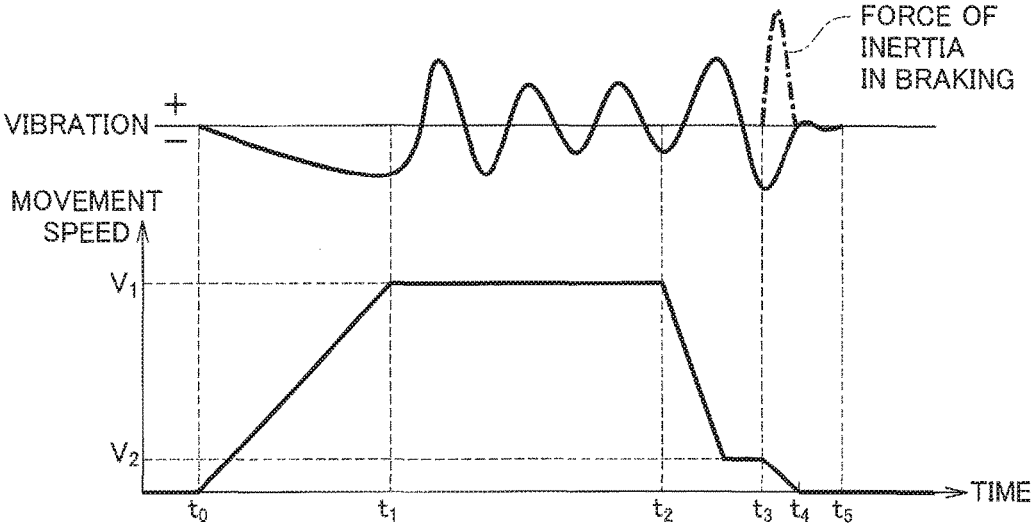
FIG. 5 is a graph illustrating an example of changes in the movement speed and vibration of the shuttle.

In step S1 of FIG. 4, the controller 5 drives the sub-scanning drive motor 12 to start moving the shuttle 4. As illustrated in FIG. 5, the controller 5 drives the sub-scanning drive motor 12 to accelerate the shuttle 4 at a predetermined acceleration rate from a time point $t_0$ which is the timing of movement start. Vibration occurs in the shuttle 4 during the acceleration.

Next, in step S2 of FIG. 4, the controller 5 determines whether the shuttle 4 has reached a predetermined speed $V_1$. When the controller 5 determines that the shuttle 4 has not reached the predetermined speed $V_1$ (step S2: NO), the controller 5 repeats step S2.

When the controller 5 determines that the shuttle 4 has reached the speed $V_1$ (step S2: YES), in step S3, as illustrated in FIG. 5, the controller 5 drives the sub-scanning drive motor 12 to start constant speed moving of the shuttle 4 at the speed $V_1$ from a time point $t_1$ which is the moment of determination.

Then, in step S4 of FIG. 4, the controller 5 determines whether it is a preset timing of starting the first stage of brake control. When the controller 5 determines that it is not the timing of starting the first stage of brake control (step S4: NO), the controller 5 repeats step S4.

When the controller 5 determines that it is the timing of starting the first stage of brake control (step S4: YES), in step S5, the controller 5 performs the first stage of brake control.

Specifically, as illustrated in FIG. 5, the controller 5 drives the sub-scanning drive motor 12 to start deceleration from the speed $V_1$ at a time point $t_2$ which is the timing of starting the first stage of brake control, and decelerates the shuttle 4 at a predetermined deceleration rate to a predetermined speed $V_2$. When the shuttle 4 is decelerated to the speed $V_2$, the controller 5 drives the sub-scanning drive motor 12 to start constant speed moving of the shuttle 4 at the speed $V_2$.

In this case, as illustrated in FIG. 6, force of inertia acts on the shuttle 4 in the movement direction thereof (forward direction) due to abrupt deceleration by the first stage of brake control. Vibration caused by the force of inertia is thus applied to the shuttle 4.

Then, in step S6, the controller 5 performs the second stage of brake control. In this case, the controller 5 determines a timing of starting the second stage of brake control in consideration of the direction of the vibration of the shuttle 4 which is detected by the vibration sensor 25. Specifically, the controller 5 drives the sub-scanning drive motor 12 to apply brake at such a timing that the direction of the force of inertia to be generated in the shuttle 4 in the braking is opposite to the direction of the vibration of the shuttle 4 detected by the vibration sensor 25, and starts the deceleration of the shuttle 4 from the speed $V_2$.

Since the direction of the force of inertia generated in the braking is forward, the timing of starting the second stage of brake control is a timing at which the direction of the vibration of the shuttle 4 is rearward. As illustrated in FIG. 5, at a time point $t_3$ which is such a timing, the controller drives the sub-scanning drive motor 12 to start the deceleration of the shuttle 4 from the speed $V_2$. In this case, as illustrated in FIG. 6, the force of inertia in the direction opposite to the direction of vibration acts on the shuttle 4. As illustrated in FIG. 5, the force of inertia of the shuttle 4 thereby cancels out the vibration of the shuttle 4. Note that, in a waveform graph of the vibration illustrated in an upper portion of FIG. 5, + indicates the forward direction and − indicates the rearward direction.

After driving the sub-scanning drive motor 12 to start the deceleration of the shuttle 4 from the speed $V_2$, the controller 5 drives the sub-scanning drive motor 12 to decelerate and stop the shuttle 4 at a predetermined position. The moving of the shuttle 4 is thereby completed.

The next print operation of one pass is started at a time point $t_5$ after a time point $t_4$ at which the shuttle 4 is stopped. At the time point $t_5$, the vibration of the shuttle 4 is converged. A decrease in print quality due to the vibration of the shuttle 4 can be thereby suppressed in the next print operation of one pass.

Figure 7:
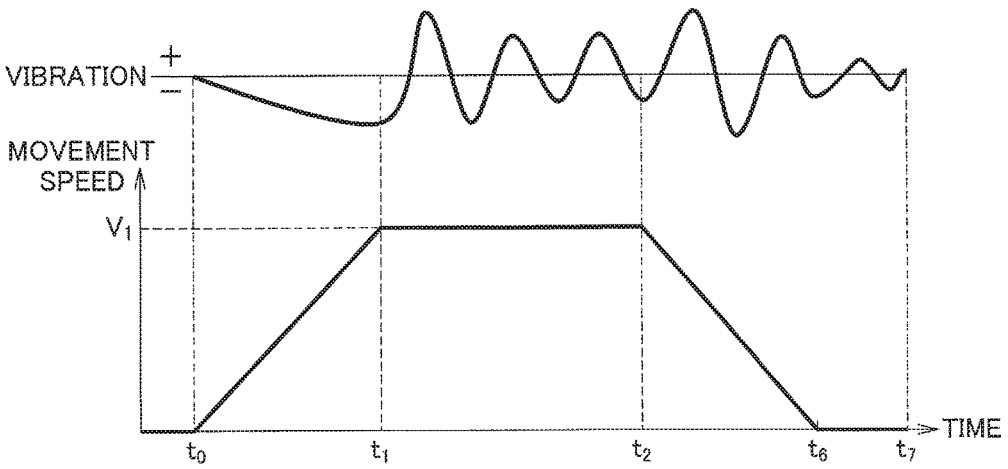
FIG. 7 is a graph illustrating changes in the movement speed and vibration of the shuttle in a comparative example.

As a comparative example, changes in the movement speed and vibration of the shuttle 4 in the case where the shuttle 4 is stopped in one-stage brake control are illustrated in FIG. 7.

In the example of FIG. 7, the movement speed and the vibration are the same as in the aforementioned example of FIG. 5 until the deceleration of the shuttle 4 from the speed $V_1$ is started at the time point $t_2$. After the start of deceleration at the time point $t_2$, the shuttle 4 is decelerated at a predetermined deceleration rate and stopped at the predetermined position at a time point $t_6$. Then, when a predetermined waiting time necessary for the vibration to stop elapses and it is time point $t_7$, the next print operation of one pass is started.

In the example of FIG. 7, since the inkjet printer 1 waits until the vibration of the shuttle 4 stops on its own, the time from the start of the moving of the shuttle 4 to the start the next print operation of one pass (time point $t_0$ to time point $t_7$) is longer than the time (time point $t_0$ to time point $t_5$) in the example of FIG. 5. In other words, in the example of FIG. 5, the next print operation of one pass can be started earlier than in the example of FIG. 7. Hence, in the example of FIG. 5, the time from the start to completion of the printing on the print medium 15 can be reduced from that in the example of FIG. 7.

In the aforementioned description of the operations in the moving of the shuttle 4, the case where the two-stage brake control is performed is described. However, the number of stages in the brake control is not limited to two.

For example, when the vibration sensor 25 detects that the amplitude of the vibration is a predetermined value or more after the second stage of the brake control, the third stage of the brake control may be performed. Also in the third stage of the brake control, the controller 5 drives the sub-scanning drive motor 12 to apply brake at such a timing that the direction of the force of inertia in the braking of the shuttle 4 is opposite to the direction of the vibration of the shuttle 4, as in the second stage of the brake control. Similar brake control can be further repeated.

As described above, in the inkjet printer 1, the controller 5 performs the multi-stage brake control to stop the shuttle 4. In the second stage and beyond of the brake control, the controller 5 applies brake at such a timing that the direction of the force of inertia in the braking of the shuttle 4 is opposite to the direction of the vibration of the shuttle 4. This can reduce the time required for the convergence of the vibration of the shuttle 4. As a result, it is possible to reduce the time from the completion of one print operation to the start of the next print operation of one pass, and thus reduce the time from the start to completion of printing on the print medium 15. Hence, the inkjet printer 1 can suppress a decrease in print quality due to the vibration of the shuttle 4 while suppressing a decrease in productivity of a printed matter.

(Second Embodiment)

Next, description is given of a second embodiment in which operations in the moving of the shuttle 4 are changed from those in the first embodiment.

In the second embodiment, the controller 5 stops the shuttle 4 by performing brake control in which the number of stages is set depending on the movement distance of the shuttle 4 in one pitch. The movement distance in one pitch is set depending on the print resolution in the sub-scanning direction.

In the second embodiment, an experiment in which the vibration sensor 25 detects the vibration of the shuttle 4 while the shuttle 4 is moved and subjected to the brake control is performed for each of movement distances in one pitch. The number of stages in the brake control and brake control contents of each stage are determined in advance based on this experiment. The number of stages in the brake control and the brake control contents of each stage are determined such that the vibration of the shuttle 4 can be converged and the shuttle 4 can be stopped at the predetermined position. The brake control contents of each stage include the timing of starting the brake control, the deceleration rate after the braking, and the movement speed after the completion of the deceleration.

Figure 8:
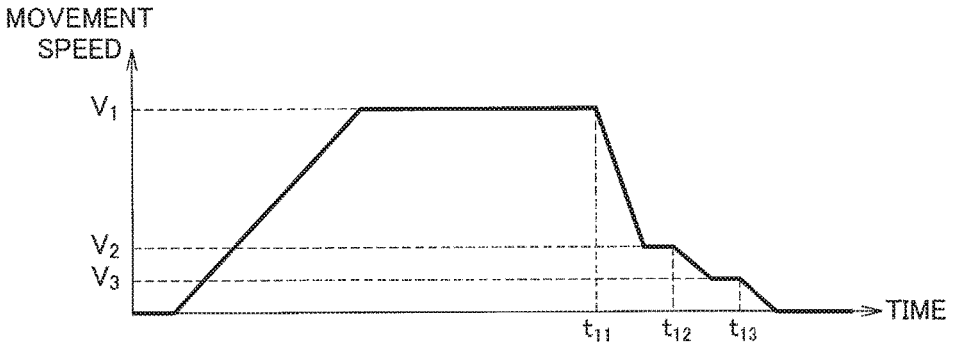
FIG. 8 is a graph explaining an example of movement speed control of the shuttle in the second embodiment.

For example, in three-stage brake control as in FIG. 8, the contents of the first stage of the brake control include a time point $t_{11}$ which is a timing at which deceleration from a speed $V_1$ is started, a deceleration rate of the deceleration started from the time point $t_{11}$, and a speed $V_2$ from a time point at which the deceleration is completed. Similarly, the contents of the second stage of the brake control include a time point $t_{12}$ which is a timing at which deceleration from a speed $V_2$ is started, a deceleration rate of the deceleration started from the time point $t_{12}$, and a speed $V_3$ from a time point at which the deceleration is completed. The contents of the third stage of the brake control include a time point $t_{13}$ which is a timing at which deceleration from a speed $V_3$ is started, a deceleration rate of the deceleration started from the time point $t_{13}$, and zero which is a movement speed from a time point at which the deceleration is completed.

As in the first embodiment, the timing of starting each stage of the brake control is determined to be such a timing that the direction of the force of inertia in the braking of the shuttle 4 is opposite to the direction of the vibration of the shuttle 4.

The controller 5 stores the number of stages in the brake control and the brake control contents of each stage for each of the predetermined movement distances in one pitch (for each of predetermined print resolutions in the sub-scanning direction).

Next, operations in the moving of the shuttle 4 in the second embodiment are described with reference to a flowchart of FIG. 9.

Figure 9:
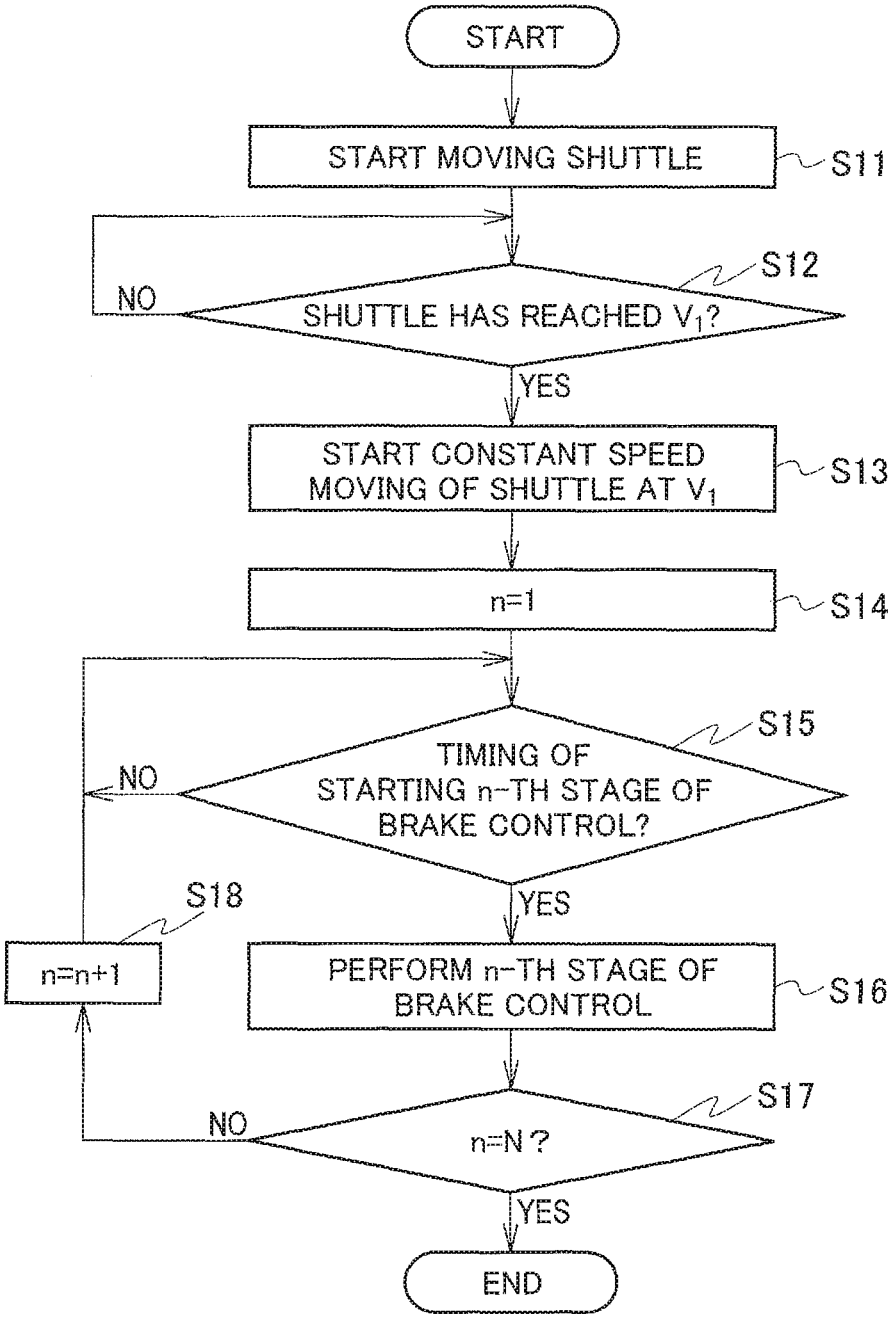
FIG. 9 is a flowchart for explaining operations in moving of the shuttle in the second embodiment.

Processing in steps S11 to S13 of FIG. 9 is the same as the aforementioned processing in steps S1 to S3 of FIG. 4.

Subsequent to step S13, in step S14, the controller 5 sets a variable n indicating the stage of the brake control to "1."

Then, in step S15, the controller 5 determines whether it is the timing of starting the n-th stage of the brake control set depending on the movement distance in one pitch in this printing. When the controller 5 determines that it is not the timing of starting the n-th stage of brake control (step S15: NO), the controller 5 repeats step S15.

When the controller 5 determines that it is the timing of starting the n-th stage of the brake control (step S15: YES), in step S16, the controller 5 drives the sub-scanning drive motor 12 according to the brake control contents of the n-th stage set depending on the movement distance in one pitch in this printing.

Next, in step S17, the controller 5 determines whether the variable n is "N" indicating the last stage.

When the controller 5 determines that n=N is not satisfied (step S17: NO), in step S18, the controller 5 increments the variable n by "1." Then, the controller 5 returns to step S15.

When the controller 5 determines that n=N is satisfied (step S17: YES), the moving of the shuttle 4 by one pitch is completed. The series of operations is thereby completed.

As described above, in the second embodiment, the controller 5 stops the shuttle 4 by performing the brake control in which the number of stages is set depending on the movement distance of the shuttle 4 in one pitch. The control depending on tendency of vibration in each movement distance of the shuttle 4 is thereby performed and the time required for the convergence of the vibration of the shuttle 4 can be thus reduced.

The present invention is not limited to the aforementioned embodiments as they are, and can be embodied with the components modified within a scope not departing from the spirit of the present invention in an implementation phase. Moreover, various inventions can be formed by appropriately combining the multiple components disclosed in the aforementioned embodiments. For example, some of the components described in the embodiments may be omitted. Moreover, the components in different embodiments may be appropriately combined.

The entire contents of Japanese Patent Application No. 2015-244833 (filed on Dec. 16, 2015) are incorporated herein by reference.

The invention claimed is:

1. An inkjet printer comprising:

a shuttle including an inkjet head and a main scanning driver configured to move the inkjet head in a main scanning direction;

a sub-scanning driver configured to move the shuttle in a sub-scanning direction; and a controller configured to control the inkjet head, the main scanning driver, and the sub-scanning driver and alternately repeat a first operation and a second operation to form an image on a print medium, the first operation being an operation of driving the inkjet head to eject ink from the inkjet head to the print medium while driving the main scanning driver to move the inkjet head in the main scanning direction, the second operation being an operation of driving the sub-scanning driver to move the shuttle in the sub-scanning direction, wherein the controller is configured to perform a multi-stage brake control to stop the shuttle in the second operation, and in a second stage and a stage after the second stage of the multi-stage brake control, apply brake to the shuttle at such a timing that a direction of vibration of the shuttle and a direction of force of inertia of the shuttle in braking of the shuttle are opposite to each other.

2. The inkjet printer according to claim 1, wherein the controller is configured to perform the multi-stage brake control of a number of stages depending on a movement distance of the shuttle in one pitch.

* * * * *